US007499006B2

(12) United States Patent
Shirasaki et al.

(10) Patent No.: US 7,499,006 B2
(45) Date of Patent: Mar. 3, 2009

(54) DISPLAY DEVICE AND METHOD FOR DRIVING DISPLAY DEVICE

(75) Inventors: Tomoyuki Shirasaki, Tokyo (JP); Kazuhito Sato, Tokyo (JP); Tsuyoshi Ozaki, Tokyo (JP); Manabu Takei, Sagamihara (JP)

(73) Assignee: Casio Computer Co., Ltd., Tokyo (JP)

( * ) Notice: Subject to any disclaimer, the term of this patent is extended or adjusted under 35 U.S.C. 154(b) by 713 days.

(21) Appl. No.: 10/794,673

(22) Filed: Mar. 5, 2004

(65) Prior Publication Data

US 2004/0189627 A1 Sep. 30, 2004

(30) Foreign Application Priority Data

Mar. 5, 2003 (JP) ..... 2003-058959

(51) Int. Cl.
*G09G 3/30* (2006.01)

(52) U.S. Cl. ..... 345/76; 345/81; 345/204; 345/207

(58) Field of Classification Search ..... 345/76–98, 345/204–215
See application file for complete search history.

(56) References Cited

U.S. PATENT DOCUMENTS 6,798,251 B1 * 9/2004 Schafferer ..... 327/52
6,943,759 B2 * 9/2005 Tam ..... 345/76

FOREIGN PATENT DOCUMENTS

JP 2002-156923 A 5/2002
JP 2003-140612 A 5/2003
WO WO 01/06484 A1 1/2001
WO WO 03/001496 A1 1/2003

* cited by examiner

*Primary Examiner*—Vijay Shankar
(74) *Attorney, Agent, or Firm*—Frishauf, Holtz, Goodman & Chick, P.C.

(57) ABSTRACT

A driver circuit for driving optical elements which is applied to a pixel driver circuit of the display device in this invention comprises a first current path with one end connected to the optical elements and the other end connected to a drive power supply; a second current path electrically connected to the first current path; a write-in control circuit which flows the write-in current having a predetermined current value in the direction of the other end side from the one end side of the first current path via the second current path; a charge storage circuit which stores the electric charge accompanying the write-in current flowing in the first current path; a drive control circuit which supplies the drive current to the optical elements via the first current path has a current value corresponding to the current value of the write-in current and drives these optical elements based on the electric charge stored in the charge storage circuit; and has a first timing operation in which the electric charge of the write-in current flowing in the first current path is stored by the write-in control circuit according to the write-in current in the charge storage circuit; and a second timing operation which supplies the drive current to the optical elements which does not overlap the time period of the first timing operation.

18 Claims, 10 Drawing Sheets

DISPLAY DEVICE AND METHOD FOR DRIVING DISPLAY DEVICE

CROSS-REFERENCE TO RELATED APPLICATION

This application is based upon and claims the benefit of priority from the prior Japanese Patent Application No. 2003-058959, filed Mar. 5, 2003, the entire contents of which is incorporated herein by reference.

BACKGROUND OF THE INVENTION

1. Field of the Invention

This invention relates to a display device and associated drive method, and more particularly comprises a display panel arranged with a plurality of display pixels which have current control type optical elements related to a display device which displays desired information and the method for driving the display device.

2. Description of the Related Art

In recent years, the increase of flat panel type display devices as monitors and displays of personal computers and video equipment has been amazing. Particularly, Liquid Crystal Displays (hereinafter denoted as "LCD") have advanced rapidly as these devices are thin-shaped, space-saving, low-powered and the like as compared to conventional display devices. In addition, relatively small LCD's remarkably have also recently spread and are widely applied as display devices in such as cellular/mobile phones, digital cameras, Personal Digital Assistants (PDA's) and the like.

Furthermore, as the display device (display) of the next generation following such an LCD, Research and Development (R&D) of the self-luminescence type display device (hereinafter denoted as a "self-luminescence type display") comprised of a display panel with optical elements arranged in a matrix form consisting of self-luminescence type light emitting devices, such as organic electroluminescent devices (hereinafter denoted as "organic EL devices"), inorganic electroluminescent devices (hereinafter denoted as "inorganic EL devices") or Light Emitting Diodes (LEDs) and the like is being actively pursued. In comparison with former LCD's, such a self-luminescence type display has a more rapid display response speed and does not have a limited viewing angle. Additionally, as high luminosity increases contrast, higher resolution display image quality using low-power and the like are realistic. Because backlight is not needed like an LCD, this very predominant feature will lead to more thin-shaped and lightweight models and full-scale utilization of such self-luminescence type displays are expected in the near future.

In the configuration which applied an active-matrix drive method in the above-mentioned self-luminescence display, optical elements are added that are composed of the above-mentioned light emitting devices. Each of the display pixels constitutes the display panel. In addition, the drive method comprises a the driver circuit (hereinafter denoted as a "pixel driver circuit" for convenience) is composed of a plurality of switching element for performing drive control of these optical elements. A configuration which drives the light emitting devices of each display pixel is known, and the drive method of the circuit configuration of a pixel driver circuit or by means of light emitting devices has been variously proposed.

FIG. 10 shows an example of a circuit configuration of prior art of a display pixel in the self-luminescence type display comprised with an organic EL device as the light emitting device.

In the display pixel of prior art, for example, as shown in FIG. 10, the pixel driver circuit DCP with optical elements comprises a Thin-Film Transistor (TFT) Tr31 and a Thin-Film Transistor Tr32. The Thin-Film Transistor Tr31 gate terminal is connected to the selection lines SL, along with the source terminal and the drain terminal each other connected to the data lines DL and contact point N31 (hereinafter denoted as "contact" for convenience of explanation) each near the intersecting point of a plurality of selection lines SL (scanning lines) and data lines DL (signal lines) arranged in a matrix form in the display panel. The Thin-Film Transistor Tr32 gate terminal is connected to contact N31 and the source terminal each other connected to the ground potential Vgnd and an optical element. The anode terminal is connected to the drain terminal of the Thin-Film Transistor Tr32 of a pixel driver circuit DCP and the cathode terminal is connected to the constant voltage Vss lower than the ground potential Vgnd. This light emitting device is constituted of an organic EL device OEL which performs luminescent operation according to the applied current.

Also, a parasitic capacitance Cp is provided between the gate-source of the Thin-Film Transistor Tr32. Furthermore, the Thin-Film Transistor Tr31 is constituted by an n-channel type MOS transistor (NMOS). The Thin-Film Transistor Tr32 is constituted by a p-channel type MOS transistor (PMOS).

Additionally, in the pixel driver circuit DCP which has such a configuration, the Thin-Film Transistors Tr31 and Tr32 are switched "ON" at predetermined timing and drive control of the organic EL device OEL performs an "OFF" control.

Thus, in the pixel driver circuit DCP, initially, when a high-level selection signal Vsel is applied to the selection lines SL, the display pixels are set to a selection state by the scanning driver and the Thin-Film Transistor Tr31 performs an "ON" operation. The signal voltage Vpix is applied to the data lines DL by the data driver according to the display signal and applied to the gate terminal of the Thin-Film Transistor Tr32 via the Thin-Film Transistor Tr31. Accordingly, the Thin-Film Transistor Tr32 performs an "ON" operation as a result of the switch-on state according to the above-mentioned signal voltage Vpix. The drive current according to the signal voltage Vpix flows in the direction of the constant voltage Vss via the Thin-Film Transistor Tr32 and the organic EL devices OEL from the ground potential Vgnd. This drive current is supplied to the organic EL devices OEL and light is emitted by the luminosity gradation according to the display signal.

Secondly, when a low-level selection signal Vsel is applied to the selection lines SL and the display pixels are set to a non-selection state, the Thin-Film Transistor Tr31 performs an "OFF" operation. The data lines DL and the pixel driver circuit DCP are electrically blocked out. Thereby, the voltage applied to the gate terminal of the Thin-Film Transistor Tr32 is stored by the parasitic capacitance Cp and the Thin-Film Transistor Tr32 maintains an "ON" state. The operation in which the drive current flows to the organic EL devices OEL via the Thin-Film Transistor Tr32 from the ground potential Vgnd is maintained and the luminescent operation is continued. This luminescent operation is controlled, for example, so that one frame periods are continuously performed until the signal voltage Vpix is written in each display pixel according to the display signal.

Since such a drive method controls the current value of the drive current flow to the light emitting devices by regulating the voltage applied to each display pixel and performs a luminescent operation by predetermined luminosity gradation, it is called a voltage drive method or the voltage application method.

However, in the display device comprised with the display pixels of the pixel driver circuit which was mentioned above, it has a problem as illustrated below.

Specifically, in the pixel driver circuit as shown in FIG. 10, when the device characteristics, such as channel resistance and the like, in the two Thin-Film Transistors Tr31 and Tr32 and the device characteristics, such as electric resistance and the like, in the organic EL devices OEL change attribute properties with the passage of time according to the surrounding temperature and operating time, the drive current supplied to the light emitting devices will fluctuate and the luminescent luminosity of the light emitting devices will vary. Thereby, the luminosity gradation characteristics of the light emitting devices in contrast with the display signal change and result in the problem of not being able to acquire stable display image quality over a long period of time.

Additionally, because the variation in operating characteristics, such as the current between source-drain of the Thin-Film Transistors Tr31 and Tr32 which constitute the pixel driver circuit, becomes greater when each of the display pixels that constitute the display panel is miniaturized to attain a higher-resolution display image quality, proper gradation control becomes complicated to resolve. Thus, the problem of variation occurring in the display properties of each display pixel causes deterioration of the image quality.

Furthermore, in the pixel driver circuit as shown in FIG. 10, since the ground potential Vgnd serves as the current supply source connected to the source terminal of the Thin-Film Transistor Tr32 which supplies drive current to the light emitting devices in the above circuit configuration and the constant voltage Vss of low electric potential is connected to the cathode side of the light emitting device rather than the current supply source, in order to operate these Thin-Film Transistors satisfactorily, it is necessary to apply a PMOS transistor. However, when a Thin-Film Transistor is provided using amorphous silicon by means of manufacturing technology already established, there is difficulty in actualizing a PMOS transistor with sufficient operating characteristics and functional capability. Thus, when a pixel driver circuit has an integrated configuration with PMOS transistors, the manufacturing technology of polysilicon or single crystal silicon must to be used. Nevertheless, in the manufacturing technology using polysilicon or single crystal silicon as compared with the manufacturing technology using amorphous silicon, the assembly process is more complicated and the production cost is expensive. Thus, there is the drawback of causing a sharp increase in the product cost of a display device comprised with the pixel driver circuit.

SUMMARY OF THE INVENTION

The present invention has been made in view of the circumstances mentioned above. Accordingly, it is the primary object of the present invention to provide a display panel comprised with an arrangement of a plurality of display pixels which have current control type optical elements. In the display device which displays desired information, while applying already established inexpensive manufacturing technology, the present invention has an advantage to acquire stabilized display image quality over a long period of time.

The driver circuit which drives optical elements applied to the pixel driver circuit in the present invention for acquiring the above-mentioned advantage comprises a first current path with one end connected to one end of the optical elements and the other end connected to a drive power supply; a second current path electrically connected to the first current path; a write-in control circuit which flows the write-in current having a predetermined current value in the direction of the other end side from one end side of the first current path via the second current path; a charge storage circuit which stores the electric charge accompanying the write-in current that flows in the first current path; a drive control circuit which supplies the drive current having a current value corresponding to the current value of the write-in current to the optical elements via the first current path and drives these optical elements based on the electric charge stored up in the charge storage circuit. The signal current supplied in the second current path has a predetermined current value and the write-in current has a current value according to the value of the signal current. Additionally, the write-in control circuit has a first timing operation in which the electric charge of the write-in current flowing in the first current path is stored by the write-in control circuit according to the write-in current in the charge storage circuit; and a second timing operation which supplies the drive current to the optical elements by the drive control circuit which does not overlap the time period of the first timing operation.

The optical elements have current control type light emitting devices which perform luminescent operation by predetermined luminosity gradation according to the current value of the drive current. These light emitting devices, for example, consist of organic electroluminescent devices. In the first timing operation, the electric potential of the end of the first current path is set as the first electric potential accordingly to become higher than the electric potential of the constant voltage regulate power source in the first timing operation which flows the write-in current to the first current path in the write-in control circuit and changes the optical elements to a reverse-bias condition; and in the electric potential of the drive power supply. In the second timing operation, the electric potential of the end of the first current path is set as the second electric potential accordingly to become lower than the electric potential of the constant voltage regulate power source in the second timing operation which flows the drive current in the drive control circuit to the optical elements and changes the optical elements to a forward-bias condition.

The write-in control circuit further comprises a third current path connected and provided between the first current path and the second current path; and the write-in current flows from the second current path to the first current path via the third current path; and a current control circuit which is provided in the third current path and controls inflow of the write-in current to the first current path. The write-in current flows in the first current path from the second current path via the third current path. The drive control circuit comprises a first switching element which is provided in the first current path and controls the current value of the drive current. The charge storage circuit comprises a capacitative element provided at least between the first switching element and the first current path. The write-in control circuit comprises a second switching element which controls operation of the first switching element. The charge storage means includes the capacitative element and parasitic capacitance provided between the first switching element and the second switching element. The capacitance value of the capacitative element in the charge storage means is set up to become lower than the parasitic capacitance. The first through third switching elements are constituted by Thin-Film Transistors consisting of n-channel type amorphous silicon.

The display device in this invention for acquiring the above-mentioned advantage comprises a display panel which comprises at least a plurality of display pixels arranged in a matrix form comprises the optical elements and a pixel driver circuit with a configuration equivalent to the above-mentioned driver circuit which controls operation of these optical elements, the selection lines where the selection signal is applied which selects each of the display pixels one line at a time, and the data lines where the signal current is supplied which has a current value according to the display signal; the pixel driver circuit comprises a first current path with one end connected to one end of the optical elements and the other end connected to the drive power supply; a second current path corresponding to a section of the data lines; a write-in control circuit which flows the write-in current in the direction of the other end side from one end side of the first current path via the second current path which has a current value according to the signal current; a charge storage circuit which stores the electric charge accompanying the write-in current which flows in the first current path; and a drive control circuit which supplies the drive current to the optical elements via the first current path and drives these optical elements based on the electric charge stored up in the charge storage circuit.

The display device further comprises a scanning driver circuit which applies the selection signal to the selection lines; and a signal driver circuit which flows the signal current to the data lines.

Additionally, the optical elements have current control type light emitting devices which perform luminescent operation by predetermined luminosity gradation according to the current value of the drive current. The light emitting devices are organic electroluminescent devices which have for example a top anode type device construction.

The drive method of the display device in the present invention for acquiring the above-mentioned advantage, in the pixel driver circuit during the selection period of each of the display pixels of each line of the display panel, the write-in current flows in the direction of the other end side from one end side of the current path by way of one end connected to the optical elements and the other end to predetermined electric potential, which has a current value according to the status signal. The electric charge according to the write-in current is stored in the capacitative element attached in the current path. During the non-selection period of each of the display pixels of each line, the drive current according to the charge stored in the capacitative element is supplied to the optical elements via the current path. In addition, during a selection period of each of the display pixels, the optical elements are placed in a non-selection state by changing the optical elements to a reverse-bias condition; and during a non-selection period of each of the display pixels, the optical elements are placed in a selection state by changing the optical elements into a forward-bias condition.

The above and further objects and novel features of the present invention will more fully appear from the following detailed description when the same is read in conjunction with the accompanying drawings. It is to be expressly understood, however, that the drawings are for the purpose of illustration only and are not intended as a definition of the limits of the invention.

DETAILED DESCRIPTION OF THE PREFERRED EMBODIMENTS

Hereinafter, the configuration of the display device and the display device drive method related to the present invention and shown in the preferred embodiment will be explained in detail.

In addition, in the embodiment shown below, although the optical elements are composed from organic EL devices and the optical elements are described as organic EL devices OEL for convenience, the present invention is not limited to this. These optical elements may be suitable with another variety of self-luminescence type light emitting devices, for example, Light Emitting Diode (LEDs) and the like. Basically, the only requirement is that these optical elements are current control type light emitting devices which perform a luminescent operation by the luminosity gradation according to the current value of the applied current.

First, the driver circuit configuration and associated drive method as applied to the pixel driver circuit of the display device related to the present invention will be explained.

<<Configuration of the Driver Circuit>>

Figure 1:
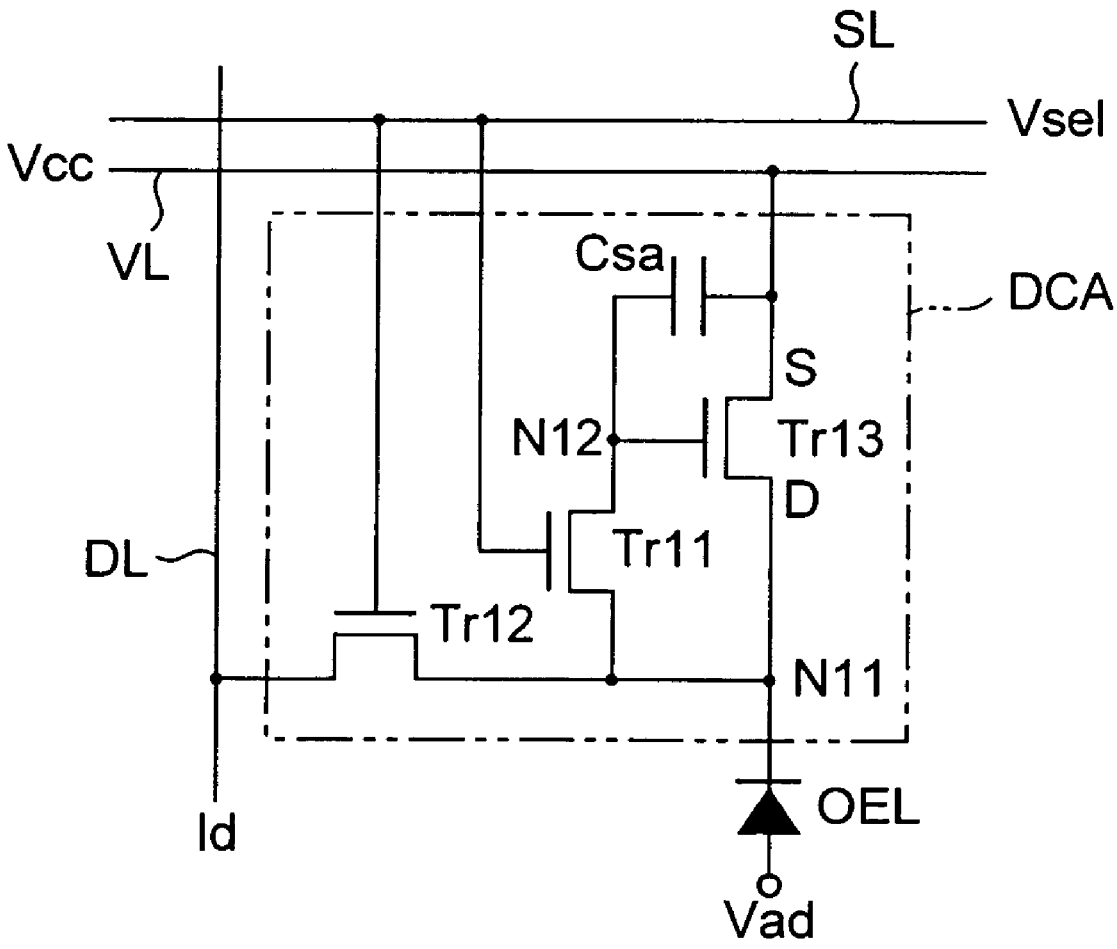
FIG. 1 is a circuit configuration drawing showing an embodiment of the driver circuit applied to the pixel driver circuit of the display device related to this invention.

FIG. 1 is a circuit configuration drawing showing an embodiment of the driver circuit applied to the pixel driver circuit of the display device related to this invention.

As shown in FIG. 1, a driver circuit DCA related to this embodiment has a configuration comprising a Thin-Film Transistor Tr12, a Thin-Film Transistor Tr11, a Thin-Film Transistor Tr13 and a capacitor Csa. For example, when applied to the pixel driver circuit DC of the display panel 110 described later (Refer to FIG. 5), the Thin-Film Transistor (TFT) Tr12 (third switching element) gate terminal is connected to the selection lines SL, along with the source terminal and drain terminal each other connected to the data lines DL (second current path) and the contact N11, near the intersecting point where the selection lines SL (scanning lines) and the data lines DL (signal lines) intersect at right angles with each other. The Thin-Film Transistor Tr11 (second switching element) gate terminal is connected to the selection lines SL, along with the source terminal and the drain terminal each other connected to the contact N11 and the contact N12. The Thin-Film Transistor Tr13 (first switching element)

drain terminal is each other connected to the contact N11, while the gate terminal is connected to the contact N12 and the source terminal is connected to the power supply lines VL (drive power supply). The capacitor Csa (charge storage means) is connected in between the contact N12 (the Thin-Film Transistor Tr13 gate terminal) and the power supply lines VL. Here, the Thin-Film Transistors Tr11 through Tr13 all consist of n-channel type amorphous silicon.

The organic EL devices OEL as the optical elements are driven by the driver circuit DCA. Current is supplied by the driver circuit DCA which drives the luminescent operation according to the current value of this current. The organic EL device OEL cathode terminal is connected to the contact N11 in above-mentioned driver circuit DCA and the anode terminal is connected to the constant voltage source which has the high electric potential Vad. The organic EL devices OEL operating in such a connection configuration are provided having a top anode type device structure.

The capacitor Csa may be parasitic capacitance provided in between the gate-source of the Thin-Film Transistor Tr13, and a capacitative element (a capacitor) can be attached separately in between the contact N12 and the power supply lines VL in addition to the parasitic capacitance.

In the driver circuit DCA which has such a configuration mentioned above, the current path between the power supply lines VL and the contact N11 in which the Thin-Film Transistor Tr13 is provided constitutes the first current path related to this invention. Additionally, the circuit configuration including the first current path, the Thin-Film Transistor Tr13 and the capacitor Csa constitute the drive control circuit related to this invention. Furthermore, the circuit configuration including the above-mentioned Thin-Film Transistor Tr12 constitutes the current control circuit related to this invention. The current path between the contact N11 and the data lines DL in which the Thin-Film Transistor Tr12 is provided constitutes the third current path related to this invention. The circuit configuration including the Thin-Film Transistor Tr11, the third current path and the Thin-Film Transistor Tr12 constitutes the write-in control circuit related to this invention.

<<The Drive Method of the Driver Circuit>>

Next, the drive method in the driver circuit which has the configuration mentioned above will be explained.

Figure 2A:
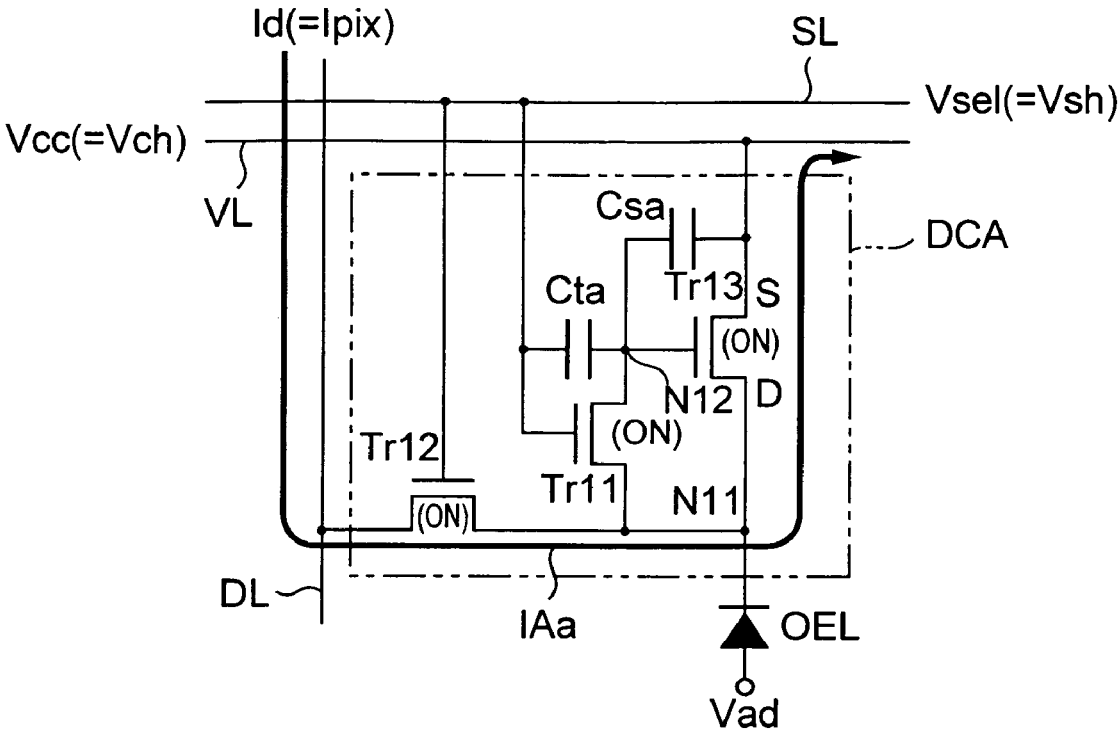
FIGS. 2A and 2B are the conceptual diagrams for explaining the operation of the drive circuit related to the embodiment.
Figure 2B:
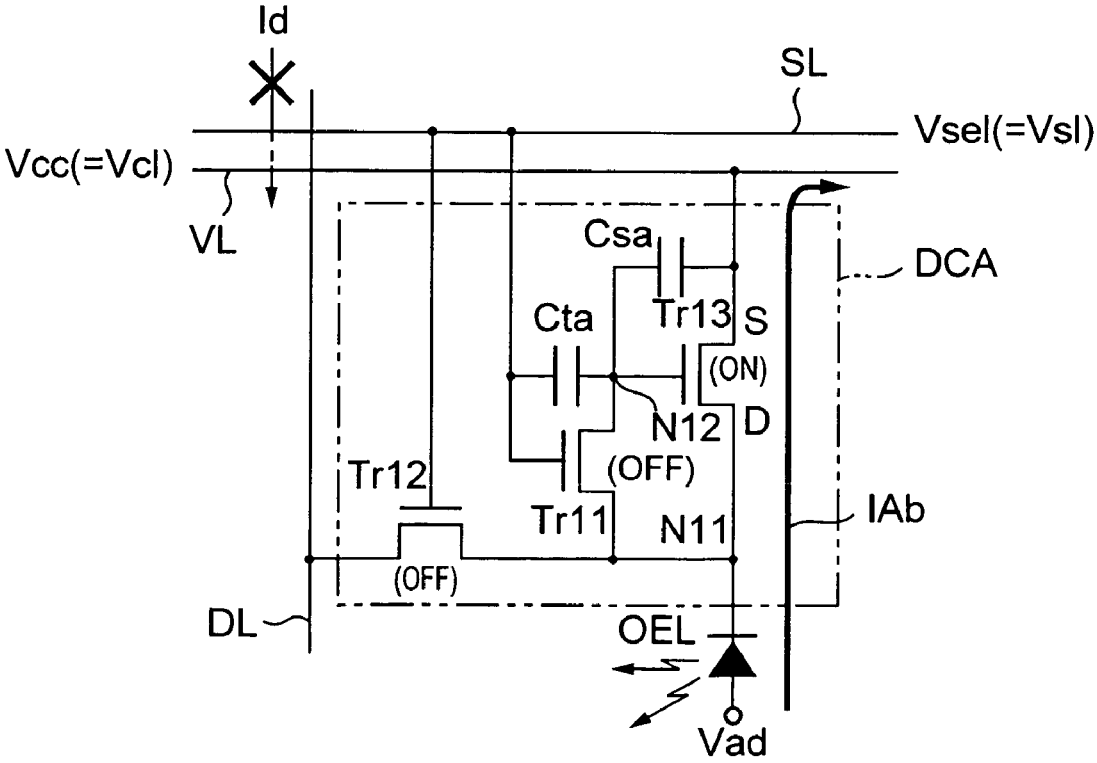

FIGS. 2A and 2B are the conceptual diagrams for explaining the operation of the drive circuit related to the embodiment.

Figure 3:
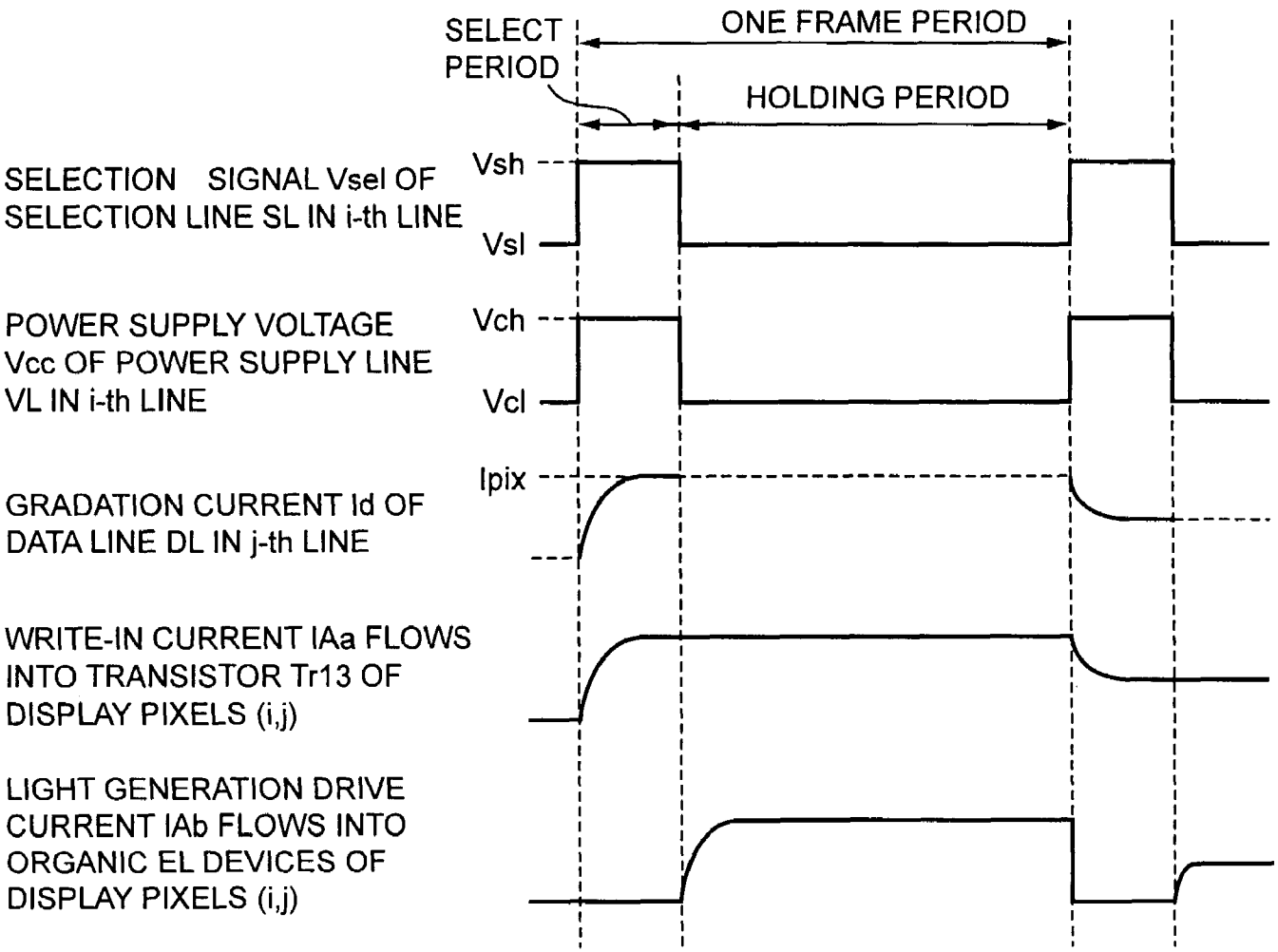
FIG. 3 is a timing chart showing the operation of the driver circuit related to the embodiment.

FIG. 3 is a timing chart showing the operation of the driver circuit related to the embodiment.

As stated above, if the driver circuit related to this embodiment has such a configuration, the voltage Vcc which has predetermined signal voltage is applied via the power supply lines VL to the source terminal side of the Thin-Film Transistor Tr13 provided in the driver circuit DCA. The cathode terminal of the organic EL devices OEL serves as the load connected to the drain terminal and the high electric potential Vad is applied to the anode terminal of the organic EL devices OEL.

Additionally, as further described later, at the same time applying the write-in method (hereinafter denoted as the "current supply source type" for convenience) which flows the gradation current at the time of the write-in operation (write-in current) in the direction of the pixel driver circuit of each of the display pixels from the data lines DL side, the drive method is applied which flows the drive current at the time of the luminescent operation in the direction of the driver circuit from the light emitting devices side. Hereinafter, this will be described in detail.

(Write-in Operation Period; First Timing Operation)

The drive method in the driver related to this embodiment is shown in FIGS. 2A and FIG. 3. Initially, in the write-in operation period (first timing operation), as the selection signal Vsel (=Vsh) which has high-level electric potential is applied to the selection lines SL of specified lines (the i-th line in FIG. 3), the voltage Vcc (=Vch) which has high-level electric potential (first electric potential) is applied to the power supply lines VL.

Synchronizing with this timing, the predetermined gradation current Id (=Ipix) (signal current) necessary to perform the luminescent operation of the organic EL devices OEL of each line (In FIG. 3, j-th line) by predetermined luminosity gradation is supplied to the data lines DL. Here, the high-level voltage Vcc (=Vch) applied to the power supply lines VL is set so to have a voltage level (Vsh>Vch) lower than the selection signal Vsel (=Vsh).

Accordingly, as shown in FIG. 2A, the gradation current Id is supplied from the data lines DL and the operation in which the Thin-Film Transistors Tr11 and Tr12 which constitute the driver circuit DCA perform an "ON" operation is accomplished.

In addition, as the voltage Vch is applied to the source terminal of the Thin-Film Transistor Tr13, the high electric potential voltage Vd is applied to the contact N11 (the Thin-Film Transistor Tr13 drain terminal) rather than the voltage Vch via the Thin-Film Transistor Tr12. Also, the high electric potential voltage is applied to the contact N12 (the Thin-Film Transistor Tr13 gate terminal) via the Thin-Film Transistor Tr11 rather than the voltage Vch. Here, the voltage Vd is set to have a voltage level higher than the high electric potential Vad (Vd>Vad) applied to the anode terminal of the organic EL devices OEL.

In this manner, when the voltage of the Thin-Film Transistor Tr13 gate terminal (contact N12) becomes higher than the voltage of the source terminal, the Thin-Film Transistor Tr13 performs an "ON" operation. As shown in FIG. 2A and FIG. 3, the write-in current IAa which has a current value equivalent to the gradation current Id (signal current) flows in the direction of the power supply lines VL via the Thin-Film Transistor Tr12, the contact N11 and the Thin-Film Transistor Tr13 from the data lines DL. At this time, the electric charge corresponding to the electric potential difference generated between the Thin-Film Transistor Tr13 gate-source is stored in the capacitor Csa (charge) and held as the voltage component (charge voltage).

Because the electric potential Vd of the contact N11 is set so as to become the high electric potential rather than the voltage Vad applied to the anode terminal of the organic EL devices OEL, the organic EL devices OEL will be in a condition where reverse-bias voltage is applied. As a result, current does not flow to the organic EL devices (optical elements) and the luminescent operation is not performed.

(Luminescent Operation Period; Second Timing Operation)

Next, in the luminescent operation period (second timing operation) of the light emitting devices after completion of the write-in operation period mentioned above, as the selection signal Vsel (=Vsl) which has low-level electric potential is applied to the selection lines SL, the voltage Vcc (=Vcl) which has low-level electric potential (second electric potential) is applied to the power supply lines VL.

Also, synchronizing with this timing, the supply operation of the gradation current Ipix to the i-th line of each driver circuit via the data lines DL is suspended.

Here, the low-level voltage Vcc (=Vcl) applied to the power supply lines VL is set to have a voltage level (Vad>Vcl) lower than the high electric potential voltage Vad applied to at least the anode terminal of the organic EL devices OEL.

Accordingly, as shown in FIG. 2B, the Thin-Film Transistors Tr11 and Tr12 which constitute the pixel driver circuit DCA perform an "OFF" operation. The write-in current IAa which flows to the contact N11 from the data lines DL via the Thin-Film Transistor Tr12 is blocked out. Thus, the capacitor Csa stores the voltage component based on the electric charge stored (charge) in the write-in operation mentioned above.

Thus, when capacitor Csa stores the charge voltage at the time of the write-in operation, the electric potential difference between the contact N11 and the contact N12 (between the Thin-Film Transistor Tr13 gate-source) is stored and the Thin-Film Transistor Tr13 maintains an "ON" state.

In addition, because the low-level voltage Vcl applied to the power supply lines VL is lower than the voltage Vad applied to anode terminal of the organic EL devices OEL, the electric potential applied to the contact N11 connected to the cathode terminal of the organic EL devices OEL becomes lower than the voltage Vad applied to anode terminal of the organic EL devices OEL. As a result, the organic EL devices OEL will be in a condition where forward-bias voltage is applied.

Therefore, as shown in FIG. 2B and FIG. 3, the light generation drive current IAb flows in the direction of the power supply lines VL via the organic EL devices OEL, the contact N11 and the Thin-Film Transistor Tr13 from the constant voltage source which has the high electric potential Vad. The light generation drive current IAb is supplied to the organic EL devices OEL, and the luminescent operation of the organic EL devices OEL (optical elements) is performed by the luminosity gradation according to the current value of the light generation drive current IAb.

Here, as the voltage component based on the electric charge stored in capacitor Csa is equivalent to the electric potential difference, as in the case of the write-in current IAa flow which has an equivalent current value to the gradation current Id in the Thin-Film Transistor Tr13, the light generation drive current IAb which flows to the organic EL devices OEL will also have an equivalent current value (Iab·IAa) to the above-mentioned write-in current IAa. Therefore, the light generation drive current IAb will have a current value equivalent to the gradation current Id. For that reason, the organic EL devices OEL emit light continuously by the luminosity gradation according to the gradation current Id.

According to the pixel driver circuit DCA mentioned above, in the write-in operation period, the gradation current Id of the current value specified according to the luminescent state (luminosity gradation) of the organic EL devices OEL is supplied. In the luminescent operation period, the current assignment method applicable to the luminescent operation of the organic EL devices OEL is performed by luminosity gradation according to the gradation current Id by controlling the light generation drive current IAb flow to the organic EL devices OEL, based on the voltage stored relative to the write-in current IAa corresponding to the current value of the gradation current Id.

Additionally, the single Thin-Film Transistor Tr13 can implement both a function (current/voltage conversion function) to change the current level of the signal current according to the desired luminosity gradation into a voltage level and a function (luminescent drive function) which supplies the light generation drive current IAb of a predetermined current value to the organic EL devices OEL. Even in the case where the operating characteristics of the Thin-Film Transistor Tr13 change, the drive current cannot be influenced by these characteristic changes and the luminescent characteristics by the predetermined luminosity gradation of the organic EL devices OEL to the gradation current Id can be kept constant. That is, the drive current which flows during the luminescent operation period via the Thin-Film Transistor Tr13 is current according to the voltage component stored in the capacitor Csa during the write-in operation. For example, when the characteristic factors of the source current relative to the gate voltage of the Thin-Film Transistor Tr13 change with the passage of time and the like, because the value of the voltage component stored in the capacitor Csa constitutes a value according to the present characteristic factor changes, the value of the drive current will not be influenced by these characteristic changes in the Thin-Film Transistor Tr13.

Furthermore, since each of the Thin-Film Transistors Tr11, Tr12 and Tr13 which constitute the pixel driver circuit DCA mentioned above are all comprised with n-channel type MOS transistors (Negative-channel Metal-Oxide Semiconductor (NMOS)) and the above-mentioned drive control operation can be performed satisfactorily, the single n-type Thin-Film Transistor using amorphous silicon is satisfactorily applicable to the above-mentioned pixel driver circuit DCA. Therefore, the manufacturing technology using the already established amorphous silicon can be applied, and circuit configuration operating characteristics which are stabilized can be implemented relatively cheaply.

The pixel driver circuit DCA related to the embodiment further as has the functional advantages as shown below.

Accordingly, as shown in FIGS. 2A and 2B, the pixel driver circuit DCA mentioned above has a configuration in which the load (optical elements) is connected to the drain terminal of the Thin-Film Transistor Tr13 comprising the current/voltage conversion function along with the luminescent drive function, and does not have what is termed a source follower type circuit configuration by which the load (optical elements) is connected to the source terminal.

In addition, the organic EL devices OEL in the embodiment have a top anode type device structure whereby the anode terminal is connected to the constant voltage regulated power source (high electric potential Vad) and does not have a top cathode type device structure whereby the cathode terminal is connected to the constant voltage regulated power source (for example, ground potential). In the circuit configuration applied the organic EL devices OEL which have such a top anode type device structure, the electric charge amount Qsa stored in the capacitor Csa during the write-in operation is expressed in the following formula (1):

$$Qsa = Csa \times (VN12 - Vch) \quad (1)$$

Here, VN12 is the voltage of the contact N12 at the time of the write-in operation and Vch is the high-level voltage applied to the power supply lines VL at the time of the write-in operation.

At this time, the electric charge amount Qta stored in the parasitic capacitance Cta provided between the gate terminal (selection lines SL) of the Thin-Film Transistor Tr11 and the contact N12 is expressed in the following formula (2):

$$Qta = Cta \times (Vsh - VN12) \quad (2)$$

Here, Vsh is the high-level selection signal applied to the selection lines SL at the time of the write-in operation.

On the other hand, in the luminescent operation period (holding period), the electric charge amount Qsa' stored in the capacitor Csa is expressed following formula (3):

$$Qsa'=Csa\times(VN12'-Vcl) \quad (3)$$

Here, VN12' is the voltage of the contact N12 at the time of the luminescent operation and Vcl is low-level voltage applied to the power supply lines VL at the time of the luminescent operation.

At this time, the electric charge amount Qta' stored in the above-mentioned parasitic capacitance Cta is expressed in following formula (4):

$$Qta'=Cta\times(Vsl-VN12') \quad (4)$$

Here, Vsl is the low-level selection signal applied to the selection lines SL at the time of the luminescent operation.

Additionally, the transition to the condition of a luminescent operation from the write-in operation mentioned above is shown in the following formula (5) supposing that the amount of change in the electric charge in each capacitor and parasitic capacitance is equal; based on the above-mentioned formula (1) through formula (4), it is expressed in the following formula (6); and the amount of change ΔVT13gs of the potential VT13gs between the gate-source of the Thin-Film Transistor Tr13 in the transition to the condition of a luminescent operation period from a write-in operation period is expressed in formula (7).

$$Qsa-Qsa'=Qta-Qta' \quad (5)$$

$$Csa\times\{(VN12-VN12')-(Vch-Vcl)\}=Cta\times\{(Vsh-Vsl)-(VN12-VN12')\} \quad (6)$$

$$\Delta VT13gs=(VN12-VN12')-(Vch-Vcl)==Cta/Csa\times(\Delta Vsel-\Delta VN12) \quad (7)$$

In addition, ΔVsel is the amount of change (Vsh−Vsl) in the voltage of the selection lines SL at the time of transition to the condition of a luminescent operation period from the write-in operation period. Similarly, ΔVN12 is the amount of change of the voltage at the contact N12 in the luminescent operation period from a write-in operation period (VN12−VN12').

Here, because the amount of change ΔVN12 of the voltage of the contact N12 shown in the above-mentioned formula (7) can be expressed like the following formula (8), the above-mentioned formula (7) is expressed like formula (9).

$$\Delta VN12=(VT13gs(\text{hold})+Vcl)-Vch \quad (8)$$

$$\Delta VT13gs=Cta/Csa\times(\Delta Vsel-VT13gs(\text{hold})-Vcl+Vch) \quad (9)$$

Here, VT13gs (hold) is the voltage between gate-source of the Thin-Film Transistor Tr13 at the time of the luminescent operation.

Therefore, according to the pixel driver circuit related to the embodiment, since the transition change over to the condition of a luminescent operation period from the write-in operation period of the potential between gate-source of the Thin-Film Transistor Tr13 does not include the argument relevant to the voltage supply between the anode terminal and the cathode terminal of the organic EL devices OEL, as shown in the above-mentioned formula (9), it does not influence the device characteristics, such as resistance of the organic EL devices OEL.

Accordingly, even when such a pixel driver circuit is applied to each display pixel which constitutes a display panel and resistance and the like of the optical elements (organic EL devices OEL) changes the attribute properties with the passage of time, the value of the drive current supplied to the optical elements (organic EL devices OEL) will not be influenced and the drive current relative to the display signal can be maintained constant. Thus, the luminosity gradation characteristics relative to the display signal will be constant over a long period of time and stable display image quality can be acquired.

In addition, in the pixel driver circuit related to the embodiment, as shown in the above-mentioned formula (9), the ratio of the capacitance value of the capacitor Csa and the capacity of the parasitic capacitance Cta (Cta/Csa) are closely related to the amount of change ΔVT13gs of the potential between the gate-source of the Thin-Film Transistor Tr13 and the amount of change ΔVN12 of the voltage at the contact N12.

Therefore, for example, by setting the capacitance value of the capacitor Csa lesser (Csa<Cta) in comparison with the parasitic capacitance Cta, the current value of the write-in current IAa relative to the light generation drive current IAb can be enlarged (IAa>IAb) by increasing the amount of change ΔVN12 of the voltage at the contact N12 at the time of the write-in operation. In this case, since the parasitic capacitance (wiring capacity) which enlarges the current value of the gradation current Id supplied to the data lines DL and added to the data lines DL can be charged rapidly, even if the display signal is of relatively low luminosity gradation, the write-in speed to the display panel can be raised and improvement of the display response characteristics can be advanced.

Furthermore, in the above-mentioned embodiment, although the circuit configuration is comprised with the three Thin-Film Transistors Tr11, Tr12 and Tr13 as the pixel driver circuit DCA was explained and shown as an example, the present invention of the pixel driver circuit DCA which applies the current assignment method is not limited to this embodiment. Relative to Thin-Film Transistors comprised with the current/voltage conversion function and luminescent drive function provided in the pixel driver circuit DCA, if the device has a connection configuration with light emitting devices (organic EL devices) which serve as the load but not connected to what is called a source follower type and the constant voltage by the constant voltage regulated power source is applied to the input terminal side (anode terminal of the organic EL devices) of these light emitting devices, it cannot be overemphasized that there can be other circuit configurations.

<<Display Device>>

Next, the driver circuit concerning the embodiment mentioned above is applied to the pixel driver circuit of the display pixels, and the display device comprised with the display panel arranged with a plurality of these display pixels in a matrix form will be explained with reference to the drawings.

Figure 4:
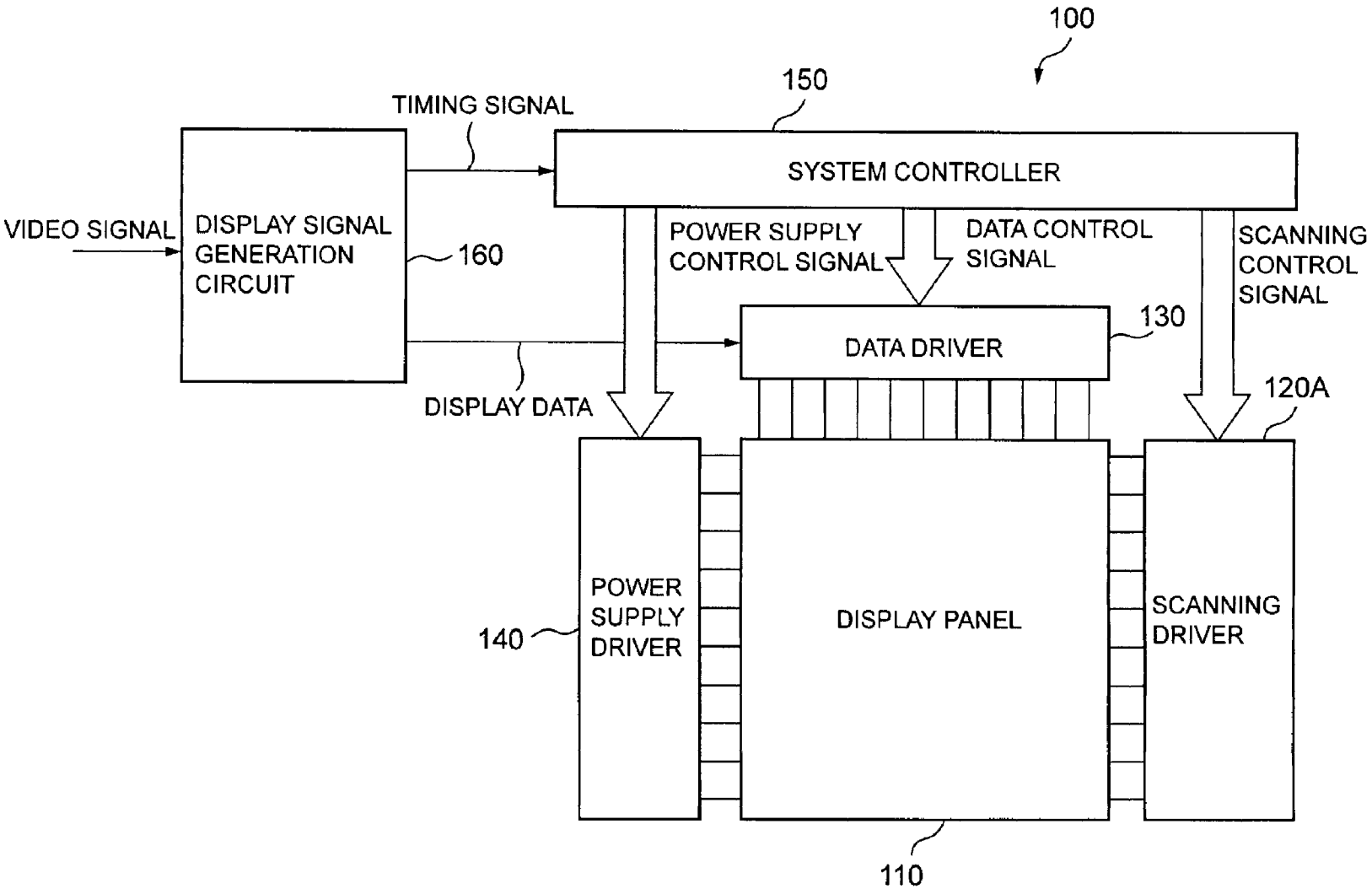
FIG. 4 is an outline block diagram showing an example of the entire configuration of the display device related to the embodiment.

FIG. 4 is an outline block diagram showing an example of the entire configuration of the display device related to the embodiment.

Figure 5:
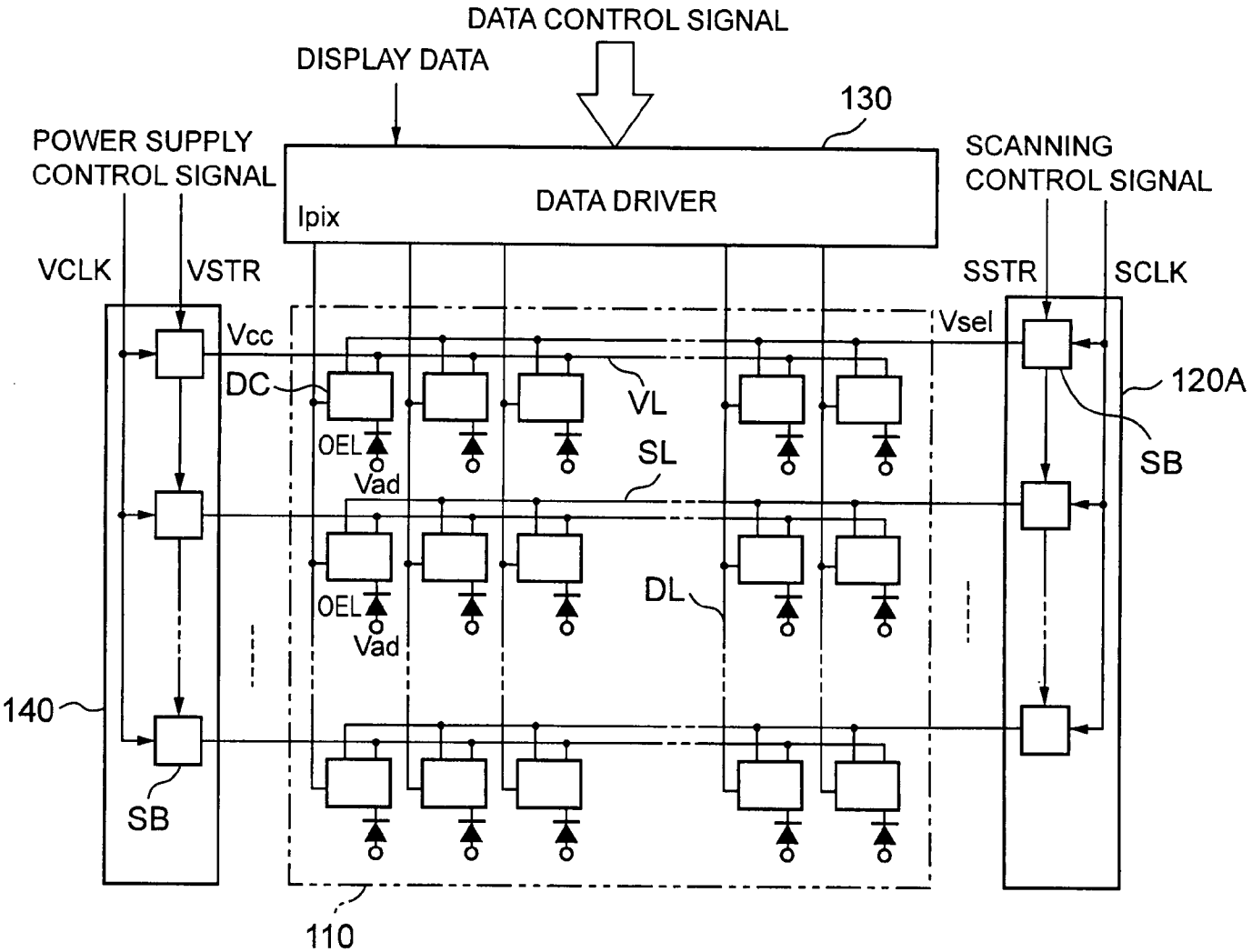
FIG. 5 is an outline block diagram showing the principal parts of the configuration in the display device related to this invention.

FIG. 5 is an outline block diagram showing the principal parts of the configuration in the display device related to this invention.

Figure 6:
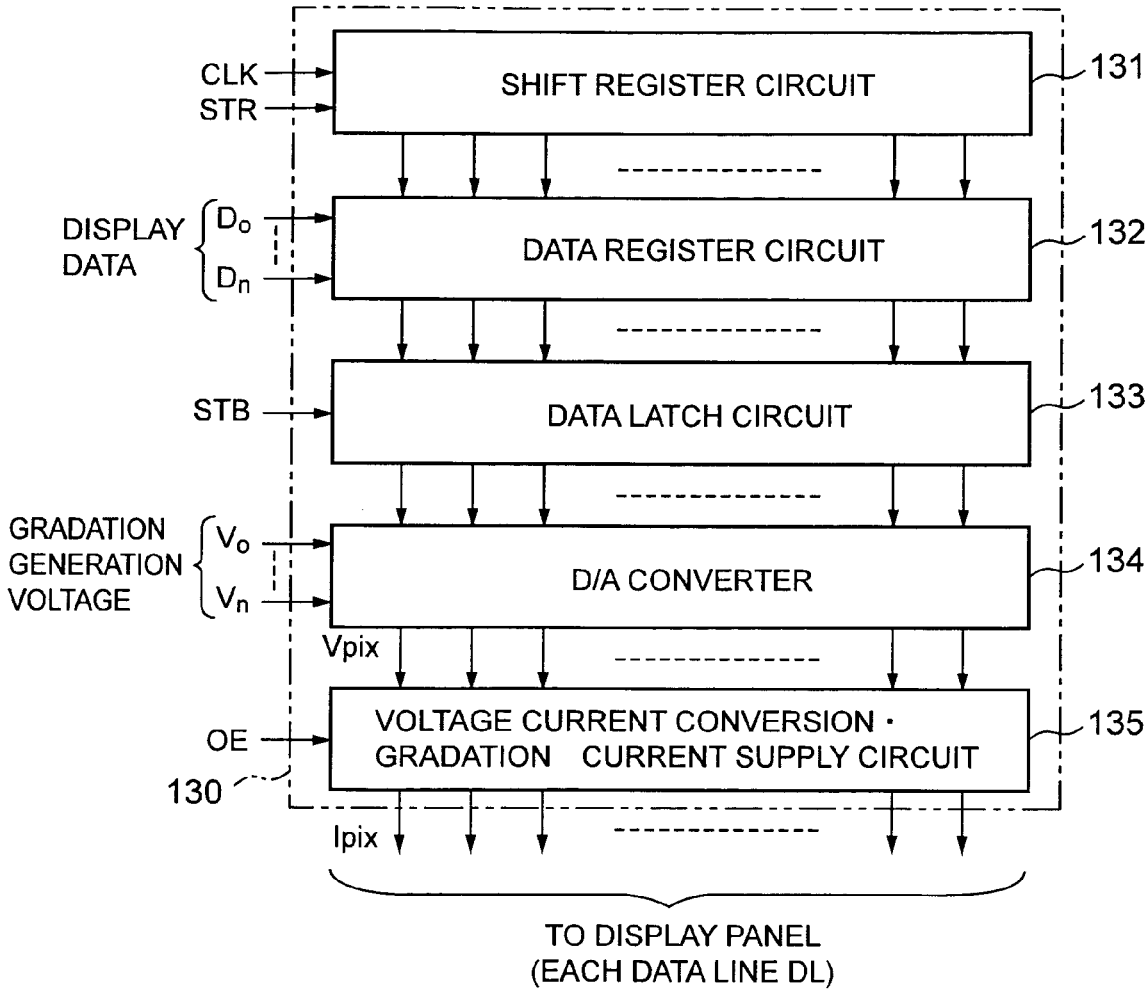
FIG. 6 is a block diagram showing the configuration relevant parts of the data driver applied to the display device related to the embodiment.

FIG. 6 is a block diagram showing the configuration relevant parts of the data driver applied to the display device related to the embodiment.

Figure 7:
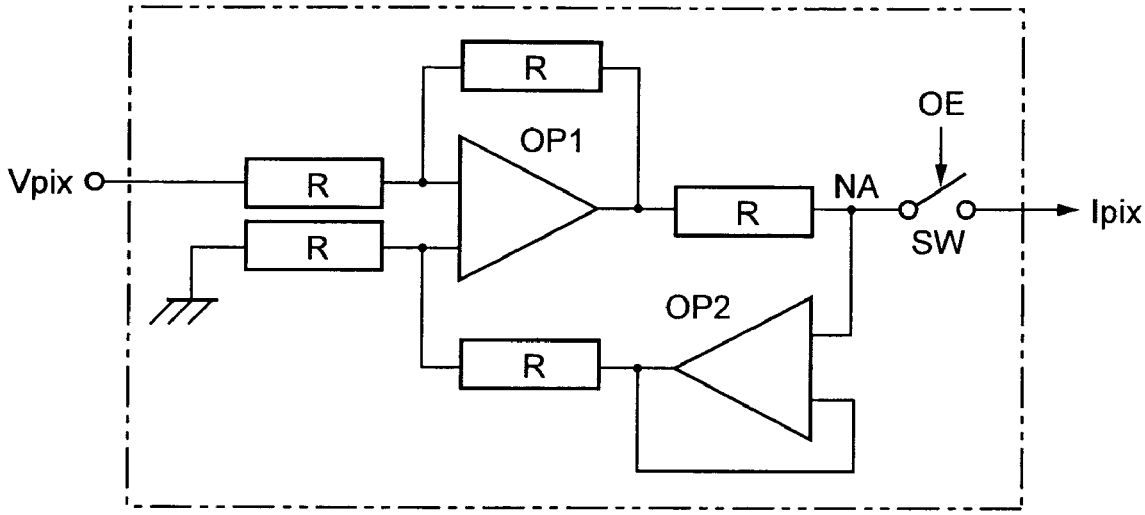
FIG. 7 is a circuit configuration drawing showing an example of the voltage current conversion and the gradation current supply circuit as applied to the data driver related to the embodiment.

FIG. 7 is a circuit configuration drawing showing an example of the voltage current conversion and the gradation current supply circuit as applied to the data driver related to the embodiment.

Figure 8:
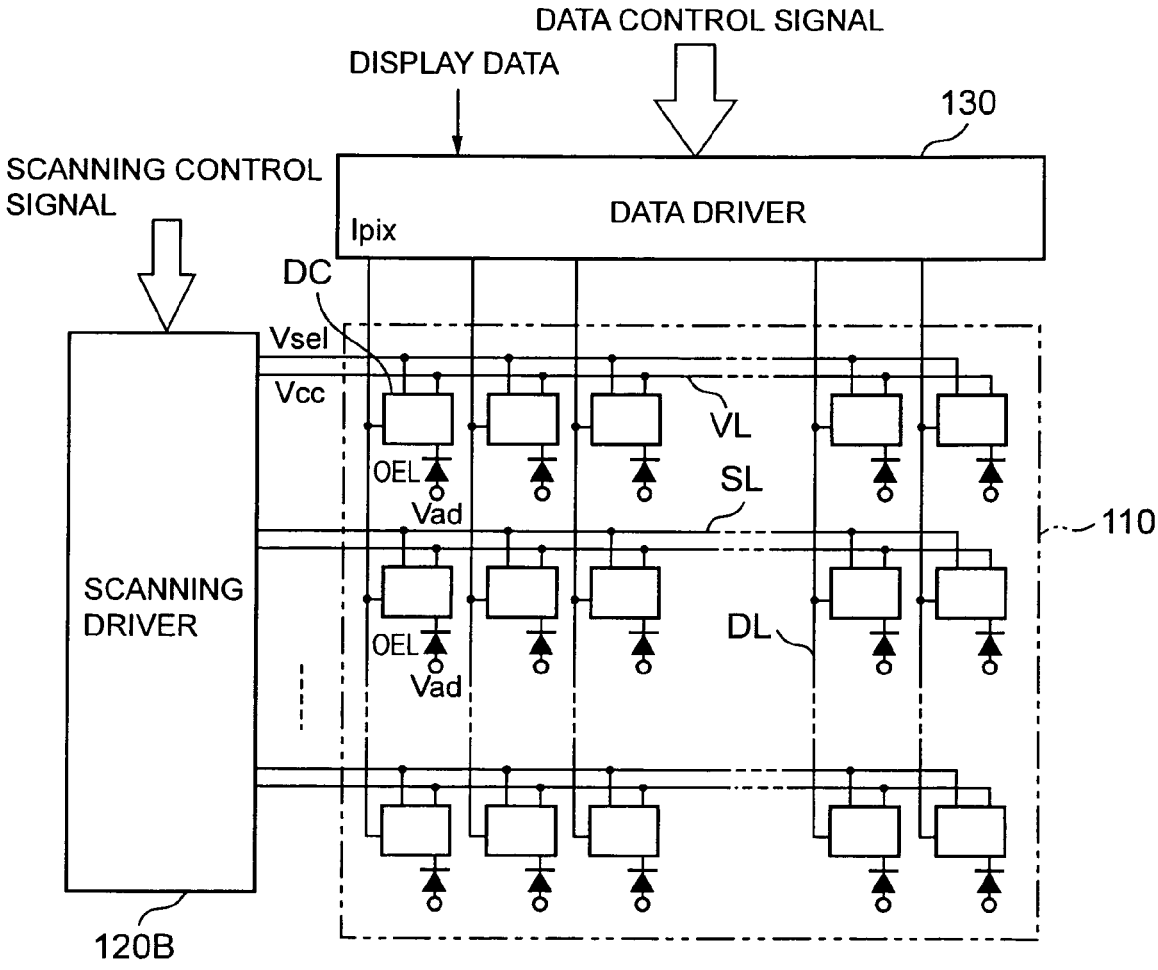
FIG. 8 is an outline block diagram showing another example of the configuration of the scanning driver in the display device related to the embodiment.

FIG. 8 is an outline block diagram showing another example of the configuration of the scanning driver in the display device related to the embodiment.

As shown in FIG. 4 and FIG. 5, the display device 100 related to the embodiment comprises a display panel 110, a scanning driver 120A, a data driver 130, a power supply driver 140, a system controller 150 and a display signal generation circuit 160. In brief, the display panel 110 has a circuit configuration equivalent to the driver circuit mentioned above constituted with a plurality of display pixels comprising the pixel driver circuit DC and the organic EL devices OEL (optical elements) arranged in a matrix form near the intersecting points of a plurality of selection lines SL (scanning lines) and power supply lines VL arranged in parallel with each other, along with a plurality of data lines DL (signal lines). The scanning driver 120A (scanning driver circuit) sets the selection state for each line of the display pixel clusters by connecting with the selection lines SL of the display panel 110 and applying a high-level selection signal Vsel (scanning signal) sequentially to each selection line at predetermined timing. The data driver 130 (signal driver circuit) is connected to each of the data lines DL of the display panel 110 and controls the supply state of the gradation current (signal current) according to the display signal to each of the data lines DL. The power supply driver 140 flows the predetermined signal current (write-in current, drive current) according to the display signal in the display pixel clusters. The system controller 150 at least controls the operating state of the scanning driver 120A, the data driver 130 and the power supply driver 140, as well as generates and outputs the scanning control signals, the data control signals and the power supply control signals based on the timing signal supplied from the display signal generation circuit 160 described later. The display signal generation circuit 160 extracts or generates the timing signals (system clock and the like) supplied to the system controller 150 for performing the image display of the display signal on the display panel 110, while the display signal is generated and the data driver 130 is supplied based on the video signal supplied externally from the display device 100.

Next, each of the above-mentioned configurations will be explained below.

(Display Panel)

The display panel 110, as shown in FIG. 5, comprises a plurality of selection lines SL (scanning lines) and power supply lines VL arranged in parallel with each other and a plurality of data lines DL (signal lines) and a plurality of display pixels arranged in a matrix form near each intersecting point of a plurality of selection lines SL and power supply lines VL and perpendicular to a plurality of data lines DL. These display pixels are the pixel driver circuit DC which control the write-in operation to the display pixels and the luminescent operation as well as the pixel driver circuit DCA mentioned above based on the scanning signal Vsel applied to the selection lines SL from the scanning driver 120A, the gradation current Ipix (signal current) supplied to the data lines DL from the data driver 130 and the voltage Vcc applied to the power supply lines VL from the power supply driver 140. The organic EL devices OEL (optical elements) by which the luminosity gradation at the time of the luminescent operation is controlled according to the current value of the drive current supplied by the pixel driver circuit DC.

Here, the pixel driver circuit DC is set as the selection state (selection period) corresponding to the write-in operation period in the driver circuit DCA mentioned above or the non-selection state (holding period) corresponding to the luminescent operation period based on the selection signal Vsel. Briefly, in a selection state, the gradation current Ipix is taken in according to the display signal and stored as a voltage level. Then, in an on-selection state, the light generation drive current IAb according to the voltage level stored is supplied to the organic EL devices OEL which have the function to emit light continuously by predetermined luminosity gradation. This will be described in more detail below.

(Scanning Driver)

The scanning driver 120A (scanning driver circuit) by applying sequentially the high-level scanning signal Vsel to each selection line SL sets the selection state for each line of the display pixels, supplies the gradation current Ipix to the data lines DL based on the display signal by the data driver 130 and controls the predetermined write-in current IAa to each of the display pixels, based on the scanning control signals supplied from the system controller 150.

Specifically, as shown in FIG. 5, a shift block SB which consists of a shift register and a buffer comprises a plurality of steps made to correspond to each of the selection lines SL. The shift signal generates shifting sequentially from the upper part to the lower part of the display panel 110 by the shift register and is applied to each of the selection lines SL as the scanning signals Vsel (=Vsh) which has a predetermined voltage level (high-level) via the buffer, based on the scanning control signals (scanning start signal SSTR, scanning clock signal SCLK, and the like) from the system controller 150 described later.

(Data Driver)

The data driver 130 (signal driver circuit) takes in and stores the display signal from the display signal generation circuit 160 at predetermined timing based on data control signals (an output power enable signal OE, a data latch signal STB, a sampling start signal STR, a shift clock signal CLK and the like) supplied from the system controller 150, converts the gradation voltage corresponding to the display signal into the current component and collectively supplies it to each of the data lines DL as the gradation current Ipix.

Specifically, the data driver 130 as shown in FIG. 6, comprises a shift register circuit 131, a data register circuit 132, a data latch circuit 133, a D/A converter 134 and a gradation current supply circuit 135. The shift register circuit 131 outputs a shift signal sequentially based on the data control signals (the shift clock signal CLK and the sampling start signal STR) supplied from the system controller 150. The data register circuit 132 takes in sequentially the display signals D0-Dn (digitized data) in one line periods supplied from the display signal generation circuit 160 based on the input timing of this shift signal. The data latch circuit 133 stores the display signals D0-Dn for one line periods taken in by the data register circuit 132 based on the data control signal (data latch signal STB). The D/A converter 134 Digital-to-Analog converter) which converts the above-mentioned stored display signals D0-Dn to predetermined analog signal voltage (gradation voltage Vpix) based on the gradation generation voltage V0-Vn supplied from a predetermined power supply means. The gradation current supply circuit 135 supplies the gradation current Ipix to each of the data lines DL arranged in the display panel 110 to the timing based on the data control signal (output power enable signal OE) supplied from the system controller 150 which generates the gradation current Ipix corresponding to the gradation voltage Vpix converted into analog signal voltage.

Here, the voltage current conversion and gradation current supply circuit 135 configuration is shown in FIG. 7 as an example of a circuit applicable to the circuit for each of the data lines DL. For example, as the gradation voltage Vpix is inputted into one input terminal via the input resistor R and the reference voltage (ground potential) is inputted into an input terminal of the other side via the input resistor R, the operational amplifier OP1 output terminal is connected to one input terminal via the feedback resistor R; while the potential of the contact NA provided in the output terminal of the operational amplifier OP1 via the output resister R is inputted into one input terminal and the output terminal is connected to the input terminal on the other side; the operational amplifier OP2 connected to the input terminal on the other side of the operational amplifier OP1 via the output resistance R; an "ON"-"OFF" operation is performed based on the output power enable signal OE supplied to the contact NA from the system controller 150. Also, it has a configuration comprised with a switching means SW to control the supply state of the gradation current Ipix to the data lines DL.

According to such voltage current conversion and a gradation current supply circuit, the gradation current Ipix which is composed of Ipix=Vpix/R is generated to the gradation voltage Vpix inputted and the data lines DL are supplied based on the input timing of the output power enable signal OE.

Therefore, according to the data driver 130 related to the embodiment, the gradation voltage Vpix according to the display signal is converted into gradation current Ipix; each of the data lines DL is supplied at predetermined timing; and controlled so that the gradation current Ipix corresponding to the display signal flows to each of the display pixels (pixel driver circuit) of the line set as the selection state.

(System Controller)

The system controller 150 outputs the scanning control signals and data control signals (the scanning shift start signal SSTR, the scanning clock signal SCLK, the shift start signal STR, the shift clock signal CLK, the latch signal STB, the output power enable signal OE and the like mentioned above) and the power supply control signals (the power start signal VSTR, the power supply clock signal VCLK and the like) which control the operational state to each of the scanning driver 120A, the data driver 130 and the power supply driver 140, as well as operates each driver at predetermined timing. The selection signal Vsel, the gradation current Ipix and the voltage Vcc having predetermined voltage levels are made to generate and output the drive control operation (write-in operation and luminescent operation) in each of the display pixels (pixel driver circuit) which are performed continuously to control the image information based on predetermined video signals which are then displayed on the display panel 110.

(Power Supply Driver)

The power supply driver 140 synchronizes with the timing (write-in operation period) to set the selection state for each line of the display pixel clusters by the above-mentioned scanning driver 120A based on the power supply control signals supplied from the system controller 150. By applying the high-level voltage Vch (voltage level lower than selection signal Vsel and the gradation voltage Vpix) to the power supply lines VL, the predetermined write-in current IAa based on the display signal is supplied in the direction of the power supply lines VL via the data lines DL and the display pixels (pixel driver circuit DC) from the data driver 130.

On the other hand, synchronizing with the timing (luminescent operation period) to set the non-selection state for each line of the display pixel clusters by the scanning driver 120A, controls the flow of the light generation light generation drive current IAb equivalent to the write-in current written based on the display signals in the direction of the power supply lines VL via the pixel driver circuit DC from the organic EL devices OEL by applying the low-level voltage Vcl to the power supply lines VL (Refer to FIGS. 2A and 2B).

Specifically, the power supply driver 140 as shown in FIG. 5, the shift block SB which is composed of a shift register and a buffer like the scanning driver 120A mentioned above, comprises a plurality of steps made to correspond to each of the power supply lines VL. Based on the power supply control signals (the power start signal VSTR, the power supply clock signal VCLK and the like) supplied from the system controller 150, the shift signal generates shifting sequentially from the upper part to the lower part of the display panel 110 by the shift register and is applied to each of the power supply lines VL as the voltages Vch and Vcl which have predetermined voltage levels (set as a selection state is high-level; set as a non-selection state is low-level by the scanning driver 120) via the buffer.

(Display Signal Generation Circuit)

The display signal generation circuit 160, for example, extracts the luminosity gradation signal component from the video signals supplied externally from the display device and supplies this to the data register circuit 132 of the data driver 130 by making this luminosity gradation component into the display signal for every one line period of the display panel 110.

Here, when the above-mentioned video signals includes a timing signal component which specifies the display timing as a television broadcast signal (composite video signal), the display signal generation circuit 160 may have the function which extracts the timing signal component besides the function which extracts the above-mentioned luminosity gradation signal component and is supplied to the system controller 150. In this case, the above-mentioned system controller 150 generates the scanning control signals and data control signals supplied to the scanning driver 120A, the data driver 130 and the power supply driver 140 based on the timing signal supplied from the display signal generation circuit 160.

In addition, as the driver attached to the periphery of the display panel 110, as shown in FIG. 4 and FIG. 5, although the configuration with the scanning driver 120A, the data driver 130 and the power supply driver 140 arranged individually was explained and as mentioned earlier above, the present invention is not limited to this as the scanning driver 120A and the power supply driver 140 can operate based on an equivalent control signal and the like (scanning control signals and power supply control signals) which synchronize with timing. For example, as shown in FIG. 8, this invention may be constituted to have the function which supplies voltage Vcc synchronizing with generation of the selection signal Vsel and output timing to the scanning driver 120B. According to such a configuration, the structure of the periphery circuits can be simplified.

Next, the drive method in the display device which has the above configuration will be explained.

Figure 9:
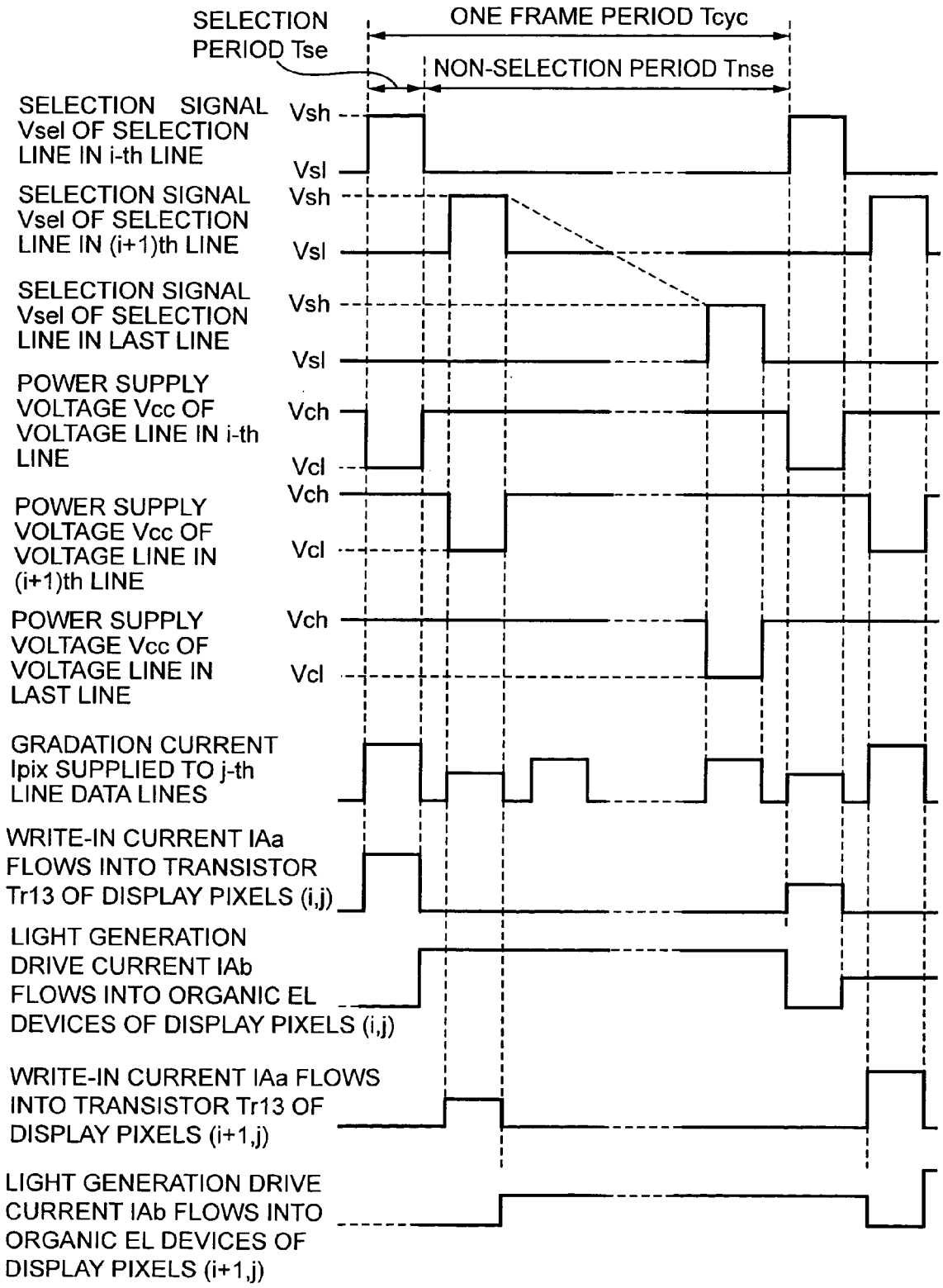
FIG. 9 is a timing chart which shows an example of the timing operation in the drive method of the display device related to the embodiment.
Figure 10:
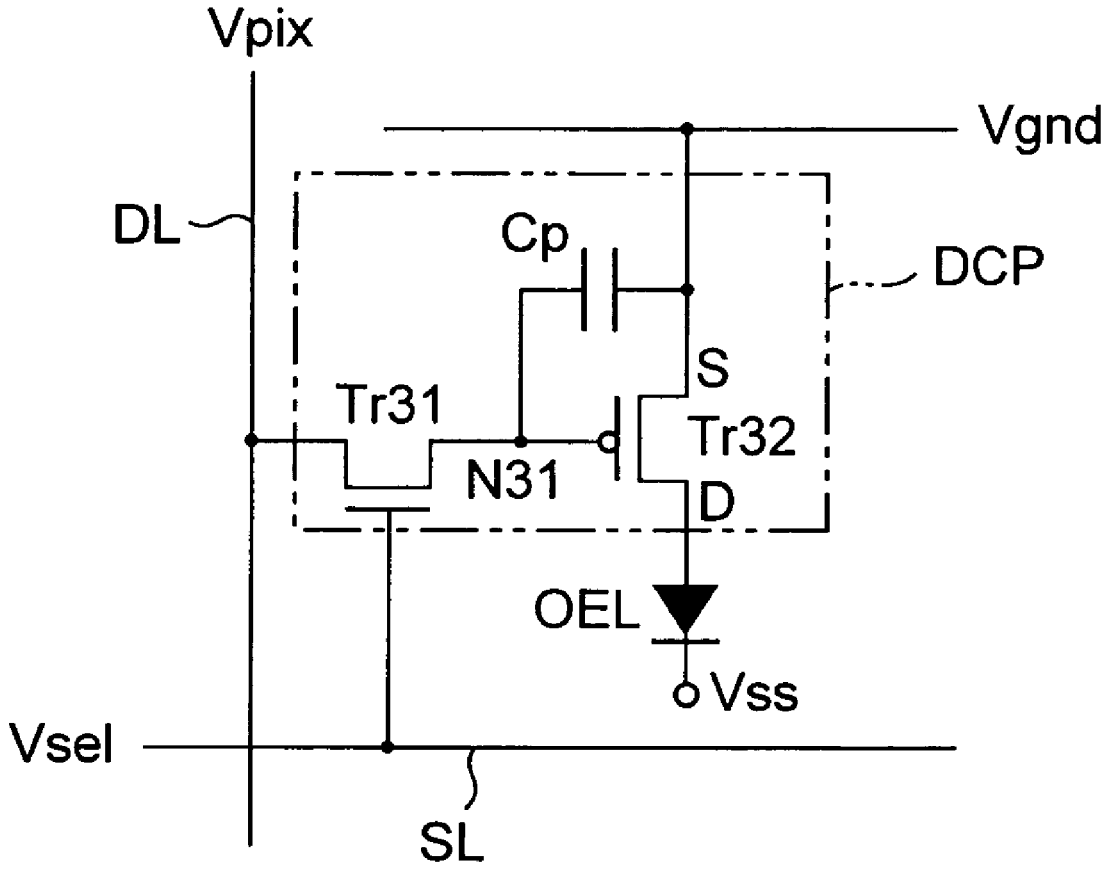
FIG.10 PRIOR ART
FIG. 10 shows an example of a prior art circuit configuration of the display pixels in a self-luminescence type display comprised with organic EL devices as the light emitting devices.

FIG. 9 is a timing chart which shows an example of the timing operation in the drive method of the display device related to the embodiment.

Also, explanation will refer accordingly to the configuration in FIGS. 2A and 2B mentioned above.

The drive method of the display device related to the embodiment is shown in FIG. 9 in the selection period Tse of the display pixels corresponding to the write-in operation period (first timing operation) shown in FIG. 2A. First, within this one frame period Tcyc by making this one frame period Tcyc into one cycle, in the selection period Tse of the display pixels, the drive method selects the display pixel clusters connected to the specified selection lines SL, supplies the pixel driver circuit DC of each of the selected display pixels so that the gradation current Ipix corresponding to the display signal flows in; flows the write-in current IAa according to the gradation current Ipix to each of the display pixels and stores as the voltage component in the capacitor Csa.

Secondly, based on the voltage component corresponding to the luminescent operation period (second timing operation) shown in FIG. 2B which is written to the capacitor Csa and stored in the above-mentioned selection period Tse, in the non-selection period Tnse, the drive method supplies so that the light generation drive current IAb according to the above-mentioned display signal flows to the pixel driver circuit DC via the organic EL devices OEL. Accordingly, in this non-selection period Tnse, the drive control which performs the luminescent operation of the organic EL devices OEL by the luminosity gradation according to the display signal is accomplished. Here, the period which totaled the selection period Tse and the non-selection period Tnse is equivalent to one frame period Tcyc. But if there is a time period overlap with each other, the selection period Tse for each line is set to remove the extent of the overlap.

As shown in FIG. 9, the display pixel clusters of the specified line (the i-th line) are received, the drive method selects by applying the selection signal (Vsh) which has high-level potential to the selection lines SL from the scanning driver 120A. The voltage Vch which has high-level potential (first electric potential) is applied to the power supply lines VL from the power supply driver 140. As the write-in current IAa corresponding to the gradation current Ipix is supplied via each of the data lines DL from the data driver 130, this write-in current is stored as the voltage component and controlled by changing the organic EL devices OEL to a reverse-bias condition so that drive current does not flow. In the subsequent luminescent operation period Tnse (non-selection period), the voltage Vcl which has low-level potential (second electric potential) is applied to the power supply lines VL from the power supply driver 140, and the organic EL devices OEL are changed to a forward-bias condition. By supplying continuously the light generation drive current IAb (.IAa) based on the voltage component stored during the above-mentioned write-in operation from the constant voltage regulated power source to the organic EL devices OEL, the operation which emits light by the luminosity gradation corresponding to the display signal is continued.

As shown in FIG. 9, based on the display signal for the display panel 1 screen, the desired image information is displayed by performing sequentially such a series of drive control operations within the one frame period Tcyc repeatedly of every line of the display pixel clusters that constitute the display panel 110.

Therefore, according to the display device related to this embodiment and method of driving the display device, the pixel driver circuit provided in each of the display pixels which constitutes the display panel such as the case of the above-mentioned driver circuit comprises a single n-type Thin-Film Transistor with both the current/voltage conversion function of the write-in current and the supply function of the drive current. Furthermore, since the circuit configuration does not have what is termed a source follower type circuit configuration, the optical elements serve as the load connected to the drain terminal. In addition, significant advantages can be acquired such as the current value of the drive current supplied to the optical elements is not influenced by operating characteristic changes of this Thin-Film Transistor; and during changeovers to the luminescent operation period from the write-in operation period, the potential between gate-source is not influenced by the characteristic factors that change properties with the passage of time in the optical elements and the like.

Accordingly, as the relation of the drive current to the display signal is maintained constant, the luminescent characteristics by the predetermined luminosity gradation of the optical elements relative to the display signal can be maintained constant and stabilized display image quality over a long period of time can be achieved.

Also, the capacitor and the parasitic capacitance which constitute the capacity component provided between the gate-source of the above-mentioned Thin-Film Transistor, the capacitative value of the parasitic capacitance is set more than the capacitor because the current value of the write-in current in order to flow predetermined drive current can be set greater. For example, when minute drive current is supplied to the light emitting devices as in the case of miniaturization of the light emitting devices, or in the case where the luminescent operation of the light emitting devices is performed at relatively low luminosity gradation, or even in the case where the write-in operation period (selection period) of each display pixel is set briefly, the wiring capacity of the data lines can be charged in a short period of time according to the gradation current which has a relatively large current value. Therefore, the display signal can be written in satisfactorily within the write-in predetermined operation period, and the display device superior display response characteristics or image quality can be achieved; thereby, having a display panel in which higher-resolution can be performed.

While the present invention has been described with reference to the preferred embodiments, it is intended that the invention be not limited by any of the details of the description thereof.

As this invention can be embodied in several forms without departing from the spirit of the essential characteristics thereof, the present embodiments are therefore illustrative and not restrictive, since the scope of the invention is defined by the appended claims rather than by the description preceding them, and all changes that fall within meets and bounds of the claims, or equivalence of such meets and bounds thereof are intended to be embraced by the claims.

What is claimed is:

1. A display device which displays image information, the display device comprising:

a display panel which comprises: (i) a plurality of display pixels arranged in a matrix form, each of the display pixels including an optical element and a pixel driver circuit which controls operation of the optical element, (ii) a plurality of selection lines to which selection signals are selectively applied to select the display pixels one line at a time, and (iii) a plurality of data lines to which signal currents having current values corresponding to display signals are supplied;

wherein each said pixel driver circuit is connected to the optical element controlled by the pixel drive circuit, and each said pixel drive circuit comprises:

a first current path having a first end connected to a first end of the optical element and a second end connected to a drive power supply;

a second current path which is formed by a section of one of the data lines;

a write-in control circuit which flows a write-in current, which has a current value corresponding to the signal current supplied to the second current path, toward a second end side of the first current path from a first end side of the first current path via the second current path;

a charge storage circuit which stores an electric charge accompanying the write-in current which flows in the first current path; and a drive control circuit which supplies a drive current, which is based on the electric charge stored in the charge storage circuit, to the optical element via the first current path to drive the optical element;

wherein respective second ends of each of the optical elements are connected to a constant voltage regulated power source having a predetermined electric potential; and wherein an electric potential of each of the optical elements is in a forward-bias condition when an electric potential at the first end of the optical element is lower than the electric potential of the constant voltage regulated power source, and the electric potential of each of the optical elements is in a reverse-bias condition when the electric potential at the first end of the optical element is higher than the electric potential of the constant voltage regulated power source.

2. The display device according to claim 1, wherein the drive current has a current value corresponding to the current value of the write-in current.

3. The display device according to claim 1, further comprising:

a scanning driver circuit which applies the selection signals to the selection lines; and a signal driver circuit which flows the signal currents to the data lines.

4. The display device according to claim 1, wherein each said pixel driver circuit has:

a first timing operation in which the electric charge of the write-in current flowing in the first current path is stored in the charge storage circuit by the write-in control circuit; and a second timing operation in which the drive current is supplied to the optical element by the drive control circuit; and wherein the second timing operation does not overlap the first timing operation.

5. The display device according to claim 1, wherein the write-in control circuit comprises:

a third current path provided between the first current path and the second current path; and a current control circuit which controls inflow of the write-in current to the first current path, and which is provided in the third current path;

wherein the write-in current flows in the first current path from the second current path via the third current path.

6. The display device according to claim 1, wherein the drive control circuit comprises a first switching element which is provided in the first current path and controls the current value of the drive current; and wherein the charge storage circuit comprises a capacitative element provided at least between the first switching element and the first current path.

7. The display device according to claim 6, wherein the write-in control circuit comprises a second switching element which controls operation of the first switching element.

8. The display device according to claim 7, wherein the charge storage circuit includes the capacitative element and parasitic capacitance provided between the first switching element and the second switching element.

9. The display device according to claim 8, wherein a capacitance value of the capacitative element in the charge storage circuit is set to become lower than the parasitic capacitance.

10. The display device according to claim 7, wherein the write-in control circuit comprises a third current path connected and provided between the first current path and the second current path; and wherein the write-in current flows from the second current path to the first current path via the third current path.

11. The display device according to claim 10, wherein the write-in control circuit comprises a current control circuit which controls inflow of the write-in current to the first current path.

12. The display device according to claim 11, wherein the current control circuit comprises a third switching element provided in the third current path which controls the inflow of the write-in current into the third current path.

13. The display device according to claim 12, wherein each of the first, second and third switching elements comprises a Thin-Film Transistor consisting of n-channel type amorphous silicon.

14. The display device according to claim 1, wherein an electric potential of the write-in control circuit and an electric potential of the drive power supply, are controlled such that an electric potential at the first end of the first current path is set as a first electric potential that is higher than the electric potential of the constant voltage regulated power source in a first timing operation in which the write-in current is flowed to the first current path, such that the optical element connected to the first end of the first current path is in the reverse-bias condition; and wherein the electric potential of the drive power supply is controlled such that the electric potential of the first end of the first current path is set as a second electric potential that is lower than the electric potential of the constant voltage regulated power source in a second timing operation in which the drive current is flowed to the optical element connected to the first end of the first current path, such that the optical element connected to the first end of the first current path is in the forward-bias condition.

15. The display device according to claim 1, wherein each of the optical elements comprises a current control type light emitting device which performs a luminescent operation by a predetermined luminosity gradation according to the current value of the drive current supplied thereto.

16. The display device according to claim 15, wherein the light emitting devices comprise organic electroluminescent devices.

17. The display device according to claim 16, wherein the organic electroluminescent devices have a top anode type device structure.

18. A display device which displays image information, the display device comprising:

a display panel which comprises: (i) a plurality of display pixels arranged in a matrix form, each of the display pixels including an optical element and a pixel driver circuit which controls operation of the optical element, (ii) a plurality of selection lines to which selection signals are selectively applied to select the display pixels one line at a time, and (iii) a plurality of data lines to which signal currents having current values corresponding to display signals are supplied;

wherein each said pixel driver circuit is connected to the optical element controlled by the pixel drive circuit, and each said pixel drive circuit comprises:

a first current path having a first end connected to a first end of the optical element and a second end connected to a drive power supply;

a second current path which is formed by a section of one of the data lines;

a third current path provided between the first current path and the second current path;

a write-in control circuit which flows a write-in current, which has a current value corresponding to the signal current supplied to the second current path, toward a second end side of the first current path from a first end side of the first current path via the third current path from the second current path, wherein the write-in control circuit comprises a current control circuit which controls inflow of the write-in current to the first current path, and which is provided in the third current path;

a charge storage circuit which stores an electric charge accompanying the write-in current which flows in the first current path; and a drive control circuit which supplies a drive current, which is based on the electric charge stored in the charge storage circuit, to the optical element via the first current path to drive the optical element.

* * * * *